US009478162B2

(12) United States Patent
Lee et al.

(10) Patent No.: US 9,478,162 B2
(45) Date of Patent: Oct. 25, 2016

(54) DISPLAY DEVICE HAVING SAFETY FUNCTIONS

(71) Applicant: Hydis Technologies Co., Ltd., Icheon-si, Gyeonggi-do (KR)

(72) Inventors: Jung Tae Lee, Suwon-si (KR); Chan Young Kim, Seoul (KR)

(73) Assignee: Hydis Technologies Co., Ltd., Gyeonggi-do (KR)

( * ) Notice: Subject to any disclaimer, the term of this patent is extended or adjusted under 35 U.S.C. 154(b) by 35 days.

(21) Appl. No.: 14/693,917

(22) Filed: Apr. 23, 2015

(65) Prior Publication Data

US 2015/0310799 A1 Oct. 29, 2015

(30) Foreign Application Priority Data

Apr. 24, 2014 (KR) ..... 10-2014-0049141

(51) Int. Cl.
*G09G 5/00* (2006.01)
*G09G 3/36* (2006.01)
*G09G 3/20* (2006.01)

(52) U.S. Cl.
CPC .... *G09G 3/2092* (2013.01); *G09G 2310/0264* (2013.01); *G09G 2320/04* (2013.01); *G09G 2330/08* (2013.01)

(58) Field of Classification Search
CPC ..... G09G 3/2092; G09G 2330/08; G09G 2310/0264; G09G 2320/04
USPC ..... 345/76–92, 204
See application file for complete search history.

(56) References Cited

U.S. PATENT DOCUMENTS

| | | | | |
|---|---|---|---|---|
| 7,190,338 | B2 | 3/2007 | Kubota et al. | |
| 7,339,570 | B2 | 3/2008 | Kubota et al. | |
| 2001/0052888 | A1* | 12/2001 | Hebiguchi | G09G 3/3666 345/87 |
| 2007/0146354 | A1* | 6/2007 | Kubota | G09G 3/2011 345/204 |
| 2013/0176318 | A1* | 7/2013 | Dunn | G09G 3/36 345/501 |

OTHER PUBLICATIONS

English Translation of KR 1020020005406, 119 pages.

* cited by examiner

*Primary Examiner* — Amit Chatly
(74) *Attorney, Agent, or Firm* — Dority & Manning, P.A

(57) ABSTRACT

A display device having safety functions may include: a display panel having unit pixel regions formed by intersecting a plurality of data lines with a plurality of gate lines; a first driving channel including a first data driving unit connected to one sides of the data lines and a first gate driving unit connected to one sides of the gate lines; and a second driving channel including a second data driving unit connected to the other sides of the data lines and a second gate driving unit connected to the other sides of the gate lines; wherein the display panel is driven by one of the first driving channel and the second driving channel.

14 Claims, 2 Drawing Sheets

DISPLAY DEVICE HAVING SAFETY FUNCTIONS

CROSS-REFERENCE TO RELATED APPLICATION

This application claims the benefit of priority under 35 U.S.C. §119(a) of Korean Patent Application No. 10-2014-0049141, filed on Apr. 24, 2014, in the Korean Intellectual Property Office, the entire disclosure of which is incorporated herein by reference for all purposes.

BACKGROUND

1. Field

The present invention relates to a display device. More specifically, the present invention relates to a display device capable of implementing safety functions for a screen displaying important information in special applications such as aircrafts and the like, without a degradation in degree of resolution.

2. Description of Related Art

In special applications such as aircrafts and the like, significantly important information may be displayed on a display device. Thus, in the event that information is not displayed on a display device due to a breakdown in partial components of the device, severe risks may be caused in the safety of the special applications.

In particular, a significant defect may not be caused in the overall transmission of information in the case that a portion of pixels is defective. However, the overall information may not be displayed in the event that a system for driving a display device is defective, to thereby cause further severe problems. Thus, it may be required for display devices to have safety functions so as to display information even in the case that a portion of the system is defective.

In connection with this, according to the related art, safety functions are implemented through a method of manufacturing a single large scale screen by attaching two independent display devices to each other, that is, a method of using a single screen by attaching two independent panels having dimensions of 10"×10" to each other in a case in which the screen has dimensions of 20"×10", or a method of dividing a single panel into two panels and displaying information only on one panel having no defects in the event that the other panel and a system therefor are problematic as described in publication US2013120664.

In addition, in publication US20130276037, safety functions are implemented by a method of providing two pairs or four pairs of RGB components in respective pixel regions and allowing the pixel regions to be driven by two systems to thereby drive a display device using one system in the case that a partial pixel region of a panel or the other one of the systems is defective.

However, in the methods as described above, in the case of the occurrence of defects, only a portion of a display screen needs to be used. Further, a plurality of pairs of RGB components are provided in each pixel region and only a portion thereof may be used to display information, whereby a degradation in degree of resolution may be caused in displaying important information.

RELATED ART DOCUMENT

US Patent Laid-Open Publication US2013/0120664 "Apparatus For Aircraft Dual Channel Display"

US Patent Laid-Open Publication US2013/0276037 "Apparatus For Aircraft Dual Channel Display"

SUMMARY

According to an aspect of the present invention, there is provided a display device having safety functions.

According to another aspect of the present invention, there is provided a display device capable of continuously performing display functions even in the case that a portion of a system for driving the display device is defective.

According to another aspect of the present invention, there is provided a display device capable of implementing safety functions without a deterioration in degree of resolution.

According to another aspect of the present invention, a display device having safety functions according to an exemplary embodiment of the present invention may include: a display panel having unit pixel regions formed by intersecting a plurality of data lines with a plurality of gate lines; a first driving channel including a first data driving unit connected to one sides of the data lines and a first gate driving unit connected to one sides of the gate lines; and a second driving channel including a second data driving unit connected to the other sides of the data lines and a second gate driving unit connected to the other sides of the gate lines; wherein the display panel is driven by one of the first driving channel and the second driving channel.

The display device may further include: a channel switching element selectively supplying power to one of the first driving channel and the second driving channel so as to allow the one of the first driving channel and the second driving channel to be operated. The channel switching element may be configured to be manually or automatically operated.

The display device may further include: a first switching unit provided between a driving IC bump and an IC output terminal of the first data driving unit and allowing or blocking a signal connection between the data lines and the first data driving unit; a second switching unit provided between a driving IC bump and an IC output terminal of the first gate driving unit and allowing or blocking a signal connection between the gate lines and the first gate driving unit; a third switching unit provided between a driving IC bump and an IC output terminal of the second data driving unit and allowing or blocking a signal connection between the data lines and the second data driving unit; and a fourth switching unit provided between a driving IC bump and an IC output terminal of the second gate driving unit and allowing or blocking a signal connection between the gate lines and the second gate driving unit, wherein when the first switching unit and the second switching unit are switched on, the third switching unit and the fourth switching unit are switched off, while when the third switching unit and the fourth switching unit are switched on, the first switching unit and the second switching unit are switched off, such that the first driving channel and the second driving channel may not influence each other.

In addition, the display device may further include: a first switching unit provided between the one sides of the data lines and the first data driving unit and allowing or blocking a signal connection between the data lines and the first data driving unit; a second switching unit provided between the one sides of the gate lines and the first gate driving unit and allowing or blocking a signal connection between the gate lines and the first gate driving unit; a third switching unit provided between the other sides of the data lines and the second data driving unit and allowing or blocking a signal connection between the data lines and the second data driving unit; and a fourth switching unit provided between the other sides of the gate lines and the second data driving unit and allowing or blocking a signal connection between the gate lines and the second gate driving unit, wherein when the first switching unit and the second switching unit are switched on, the third switching unit and the fourth switching unit are switched off, while when the third switching unit and the fourth switching unit are switched on, the first switching unit and the second switching unit are switched off, such that the first driving channel and the second driving channel may not influence each other.

The first switching unit and the second switching unit may be switched on or off by a power signal input to the first driving channel, and the third switching unit and the fourth switching unit may be switched on or off by a power signal input to the second driving channel.

The first to fourth switching units may be configured to include a plurality of switching elements, gate electrodes of the switching elements configuring each of the switching units may be connected to each other, a power signal supplied to each of the driving channels may be connected to the gate electrodes connected to each other, and when the first driving channel is operated, the first switching unit and the second switching unit are switched on and the third switching unit and the fourth switching unit are switched off, while when the second driving channel is operated, the first switching unit and the second switching unit are switched off and the third switching unit and the fourth switching unit are switched on.

BRIEF DESCRIPTION OF DRAWINGS

The above and other aspects, features and other advantages of the present invention will be more dearly understood from the following detailed description taken in conjunction with the accompanying drawings, in which.

DETAILED DESCRIPTION

Figure 1:
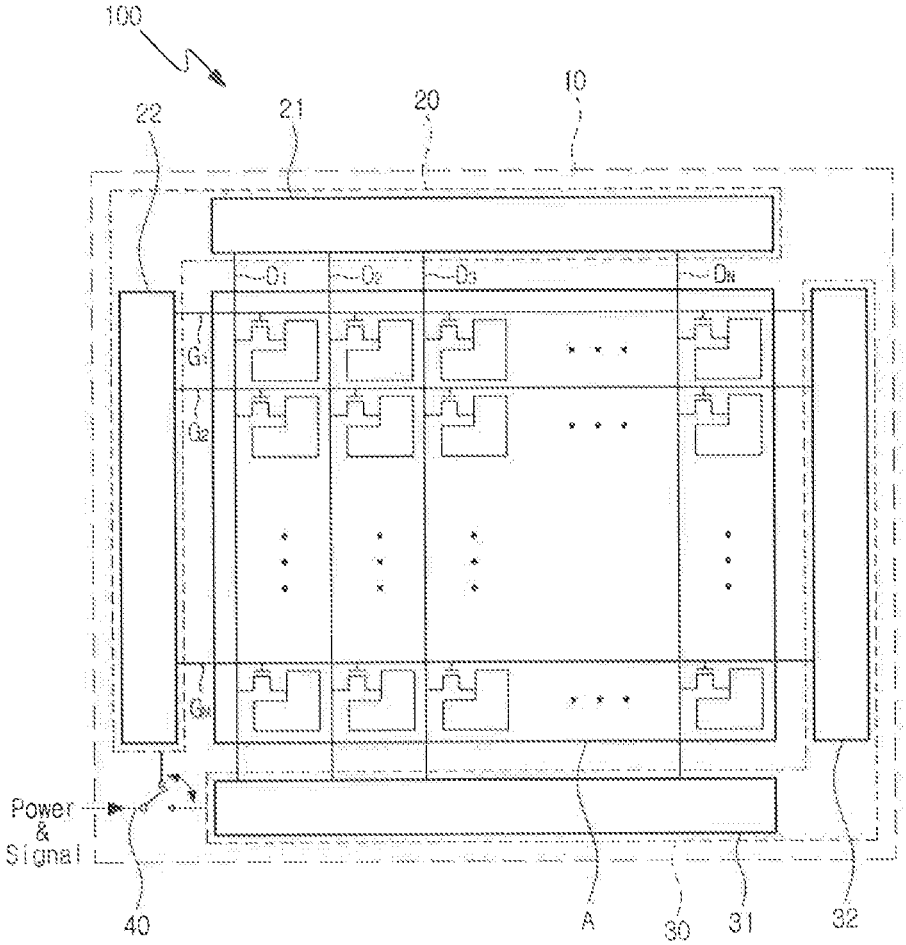
FIG. 1 is a schematic diagram of a display device according to an exemplary embodiment of the present invention.

Exemplary embodiments of the present invention will now be described in detail with reference to the accompanying drawings.

The invention may, however, be exemplified in many different forms and should not be construed as being limited to the specific embodiments set forth herein. Rather, these embodiments are provided so that this invention will be thorough and complete, and will fully convey the scope of the invention to those skilled in the art.

In the drawings, the shapes and dimensions of elements may be exaggerated for clarity, and the same reference numerals will be used throughout to designate the same or like elements.

FIG. 1 is a schematic diagram of a display device according to an exemplary embodiment of the present invention.

As illustrated in FIG. 1, a display device 100 according to an exemplary embodiment of the present invention may be configured to include a display panel 10, a first driving channel 20, and a second driving channel 30.

The display panel 10 is a device for displaying information on a visible area A, and a plurality of data lines $D_1$ to $D_N$ and a plurality of gate lines $G_1$ to $G_M$ may intersect with each other to form unit pixel regions in order to display information on the visible area.

The first driving channel 20 may be configured to include a first data driving unit 21 connected to one sides of the data lines to supply data signals and a first gate driving unit 22 connected to one sides of the gate lines to supply gate signals.

In the case of a general display device, a display panel thereof may be driven by a single driving channel. However, the display device according to an exemplary embodiment of the present invention may further include the second driving channel in preparation for the case in which information is inappropriately displayed on the display panel due to a breakdown in the first driving channel or the like.

The second driving channel 30 may be configured to include a second data driving unit 31 connected to the other sides of the data lines to supply data signals and a second gate driving unit 32 connected to the other sides of the gate lines to supply gate signals.

In the display device according to an exemplary embodiment of the present invention, the first driving channel may be connected to the one sides of the data lines and the one sides of the gate lines to provide the signals required for displaying information, and in the case that the display of information on the display panel through the first driving channel is abnormal, signals required for displaying information may be provided by the second driving channel connected to the other sides of the data lines and the other sides of the gate lines. Thus, even in an abnormal case in which the first driving channel is abnormally operated, all pixel regions rather than a portion of the pixel regions, of the display panel may be normally operated, such that information may be displayed without a deterioration in degree of resolution.

In addition, an exemplary embodiment of the present invention describes the second driving channel as an auxiliary driving channel, but the second driving channel may be a driving channel used during a normal operation. Even in cases except for the abnormal case, the first driving channel and the second driving channel may be alternately operated.

Power and signals may be selectively supplied to the first driving channel and the second driving channel by a channel switching element 40 as illustrated in FIG. 1, whereby only one of the two driving channels may be used to drive the display panel.

The channel switching element 40 may be an automatic switching element, automatically sensing the occurrence of abnormality in a driving of the display panel and switched so as to allow power and signals to be input to the remaining driving channel from a currently used driving channel, and may be a passive switching element switched according to a user's selection.

In the display panel according to an exemplary embodiment of the present invention, a first data driving circuit and a second data driving circuit may be connected to both sides of the data lines, and a first gate driving circuit and a second gate driving circuit may be connected to both sides of the gate lines so as to allow all pixel regions to be operated all the time.

Thus, when the display panel is driven by the first driving channel, an output signal from the first driving channel may influence the second driving channel connected to the other sides of the data lines and the gate lines. When the display panel is driven by the second driving channel, an output signal from the second driving channel may influence the first driving channel connected to the one sides of the data lines and the gate lines, in addition, since output terminals of the first driving channel and the second driving channel are connected to each other as described above, they are in a high impedance state, which may influence the display panel.

In another exemplary embodiment of the present invention, in order to prevent the defect, when the display panel is driven by the first driving channel, the data lines and the gate lines may not be connected to the second driving channel. Meanwhile, when the display panel is driven by the second driving channel, the data lines and the gate lines may not be connected to the first driving channel.

Figure 2:
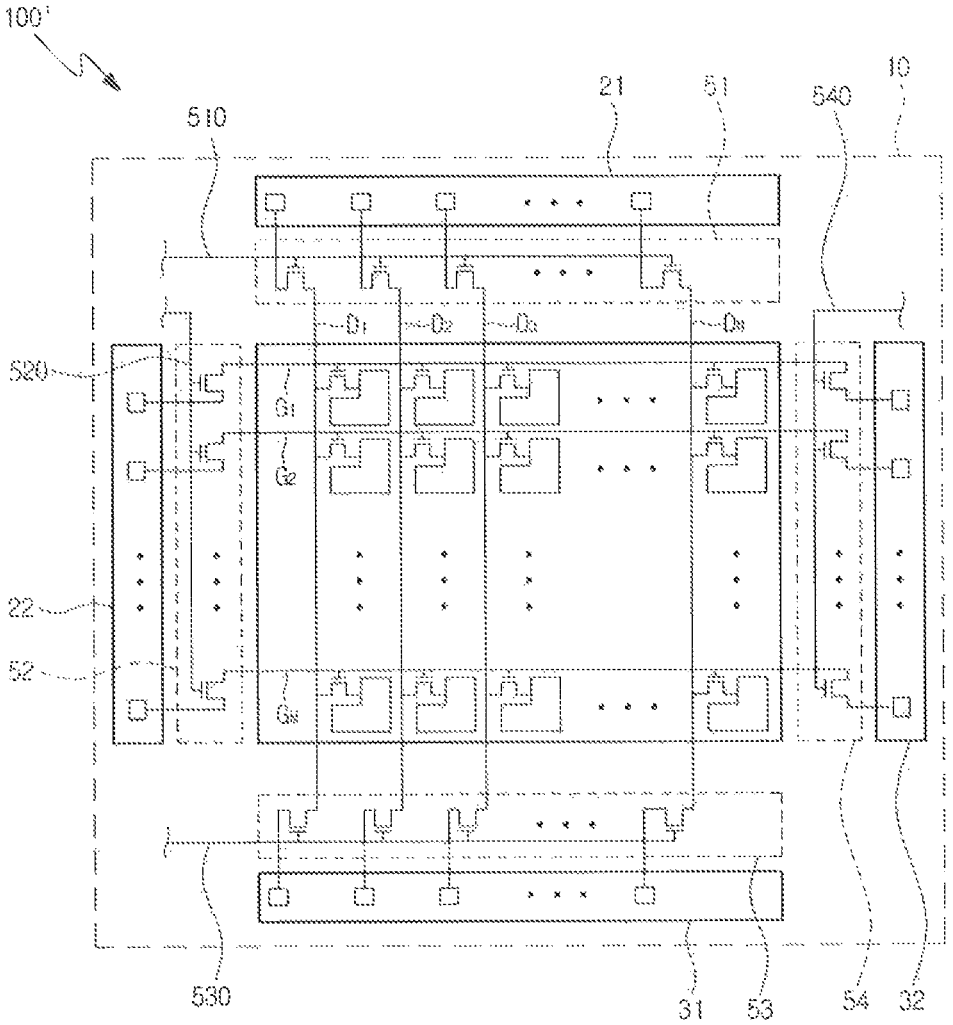
FIG. 2 is a schematic diagram of a display device according to another exemplary embodiment of the present invention.

FIG. 2 illustrates a display device 100' according to another exemplary embodiment of the present invention. The display device according to another exemplary embodiment of the present invention will be described in detail with reference to FIG. 2.

The display device 100' according to another exemplary embodiment of the present invention may include a first switching unit 51 between one sides of data lines and the first data driving unit 21, a second switching unit 52 between one sides of gate lines and the first gate driving unit 22, a third switching unit 53 between the other sides of the data lines and the second data driving unit 31, and a fourth switching unit 54 between the other sides of the gate lines and the second gate driving unit 32.

When the display panel 10 is driven by the first driving channel 20, the first switching unit 51 and the second switching unit 52 may be switched on, such that a data signal and a gate signal from the first driving channel 20 may be supplied to the data lines and the gate lines, while the third switching unit 53 and the fourth switching unit 54 may be switched off, such that the signals supplied from the first driving channel may not be input to the second driving channel.

Meanwhile, when the display panel 10 is driven by the second driving channel 30, the third switching unit 53 and the fourth switching unit 54 may be switched on, such that a data signal and a gate signal from the second driving channel 30 may be supplied to the data lines and the gate lines while the first switching unit 51 and the second switching unit 52 may be switched off, such that the signals supplied from the second driving channel 30 may not be input to the first driving channel.

The switching units as described above may be configured as switching elements TFT respectively formed between the first data driving unit and the one sides of the data lines, between the first gate driving unit and the one sides of the gate lines, between the second data driving unit and the other sides of the data lines, and between the second gate driving unit and the other sides of the gate lines.

The switching elements of the respective switching units may be simultaneously switched on or off. Thus, gate electrodes of a plurality of switching elements configuring each of the switching units may be preferably connected to each other through single lines 510, 520, 530 and 540.

In addition, the first switching unit and the second switching unit may be simultaneously switched on or off. The third switching unit and the four switching unit may also be simultaneously switched on or off. Thus, it may be preferable to connect the first line 510 connecting the gate electrodes of the first switching unit to the second line 520 connecting the gate electrodes of the second switching unit to each other and to connect the third line 530 connecting the gate electrodes of the third switching unit to the four line 540 connecting the gate electrodes of the four switching unit to each other.

In addition, the first switching unit and the second switching unit may need to be switched on when the first driving channel is operated and need to be switched off when the second driving channel is operated. The third switching unit and the four switching unit may need to be switched on when the second driving channel is operated and need to be switched off when the first driving channel is operated. Thus, it may be preferable that at least a portion of power supplied to operate the first driving channel may be provided to the first line 510 and the second line 520, while at least a portion of power supplied to operate the second driving channel may be provided to the third line 530 and the four line 540.

When power is supplied to the first driving channel 20 through such a configuration, the first switching unit and the second switching unit may be automatically switched on and the third switching unit and the fourth switching unit may be switched off. When power is supplied to the second driving channel 30, the first switching unit and the second switching unit may be switched off and the third switching unit and the fourth switching unit may be switched on.

In addition, source electrodes of the switching elements may be connected to the data driving circuit or the gate driving circuit, and drain electrodes thereof may be connected to the data lines or the gate lines, such that data signals may be supplied from the data driving circuit to the data lines and gate signals may be supplied from the gate driving circuit to the gate lines.

The first to fourth switching units described as above may be configured as switching elements formed in an amount equal to the number of channels of driving ICs between driving IC bumps and IC output terminals of the data driving unit and the gate driving unit, in this case, the source electrodes of the switching elements may be connected to the driving IC bumps, the drain electrodes thereof may be connected to the IC output terminals, and gate electrodes thereof may be connected to each other through single lines as described above, such that they are configured to receive a power signal input to the driving channel.

Since the switching elements are merely different from the switching elements illustrated in FIG. 2 in terms of positions in which they are installed, other configurations thereof are identical, a detailed description of the switching units provided in the data driving unit and the gate driving unit will be omitted.

As set forth above, according to exemplary embodiments of the present invention, a display device having safety functions, capable of continuously performing display functions even in the case that a portion of systems thereof is defective, without a deterioration in level of resolution.

Until now, a display device having safety functions according to exemplary embodiments of the present invention has been limitedly described with reference to concrete examples. However, the present invention is not limited to the concrete examples.

While exemplary embodiments have been shown and described above, it will be apparent to those skilled in the art that modifications and variations could be made without departing from the spirit and scope of the present invention as defined by the appended claims.

What is claimed is:

1. A display device having safety functions, comprising:

a display panel forming unit pixel regions by intersecting a plurality of data lines with a plurality of gate lines;

a first driving channel including a first data driving unit connected to one sides of the data lines and a first gate driving unit connected to one sides of the gate lines;

a second driving channel including a second data driving unit connected to the other sides of the data lines and a second gate driving unit connected to the other sides of the gate lines;

a first switching unit including a plurality of first switching elements which allow or block a signal connection between the data lines and the first data driving unit;

a second switching unit including a plurality of second switching elements which allow or block a signal connection between the gate lines and the first gate driving unit;

a third switching unit including a plurality of third switching elements which allow or block a signal connection between the data lines and the second data driving unit; and a fourth switching unit including a plurality of fourth switching elements which allow or block a signal connection between the gate lines and the second gate driving unit, wherein gate electrodes of the plurality of first switching elements are connected to each other, and at least a portion of signals input to the first driving channel is input to the gate electrodes of the first switching elements connected to each other, to thereby allow the first switching unit to be switched on;

gate electrodes of the plurality of second switching elements are connected to each other, and at least a portion of the signals input to the first driving channel is input to the gate electrodes of the second switching elements connected to each other, to thereby allow the second switching unit to be switched on;

gate electrodes of the plurality of third switching elements are connected to each other, and at least a portion of signals input to the second driving channel is input to the gate electrodes of the third switching elements connected to each other, to thereby allow the third switching unit to be switched on;

gate electrodes of the plurality of fourth switching elements are connected to each other, and at least a portion of the signals input to the second driving channel is input to the gate electrodes of the fourth switching elements connected to each other, to thereby allow the fourth switching unit to be switched on; and the display panel is driven by one of the first driving channel and the second driving channel.

2. The display device of claim 1, further comprising: a channel switching element selectively supplying power to one of the first driving channel and the second driving channel so as to allow the one of the first driving channel and the second driving channel to be operated.

3. The display device of claim 2, wherein the channel switching element is manually or automatically operated.

4. The display device of claim 1, wherein the plurality of first switching elements (TFT) are provided between driving IC bumps and IC output terminals of the first data driving unit;

the plurality of second switching elements (TFT) are provided between driving IC bumps and IC output terminals of the first gate driving unit;

the third switching elements (TFT) are provided between driving IC bumps and IC output terminals of the second data driving unit; and the plurality of fourth switching elements (TFT) provided between driving IC bumps and IC output terminals of the second gate driving unit.

5. The display device of claim 1, wherein the plurality of first switching elements (TFT) are provided between the one sides of the data lines and the first data driving unit;

the plurality of second switching elements (TFT) are provided between the one sides of the gate lines and the first gate driving unit;

the plurality of third switching elements (TFT) are provided between the other sides of the data lines and the second data driving unit; and the plurality of fourth switching elements (TFT) are provided between the other sides of the gate lines and the second gate driving unit.

6. The display device of claim 1, wherein the first switching unit and the second switching unit are switched on or off by a power signal input to the first driving channel, and the third switching unit and the fourth switching unit are switched on or off by a power signal input to the second driving channel.

7. The display device of claim 5, wherein the first switching elements have source electrodes thereof connected to the first data driving unit and drain electrodes thereof connected to the one sides of the data lines;

the second switching elements have source electrodes thereof connected to the first gate driving unit and drain electrodes thereof connected to the one sides of the gate lines;

the third switching elements have source electrodes thereof connected to the second data driving unit and drain electrodes thereof connected to the other sides of the data lines; and the fourth switching elements have source electrodes thereof connected to the second gate driving unit and drain electrodes thereof connected to the other sides of the gate lines.

8. The display device of claim 1, wherein when the first switching unit and the second switching unit are switched on, the third switching unit and the fourth switching unit are switched off, while when the third switching unit and the fourth switching unit are switched on, the first switching unit and the second switching unit are switched off.

9. The display device of claim 2, wherein when the first switching unit and the second switching unit are switched on, the third switching unit and the fourth switching unit are switched off, while when the third switching unit and the fourth switching unit are switched on, the first switching unit and the second switching unit are switched off.

10. The display device of claim 3, wherein when the first switching unit and the second switching unit are switched on, the third switching unit and the fourth switching unit are switched off, while when the third switching unit and the fourth switching unit are switched on, the first switching unit and the second switching unit are switched off.

11. The display device of claim 4, wherein when the first switching unit and the second switching unit are switched on, the third switching unit and the fourth switching unit are switched off, while when the third switching unit and the fourth switching unit are switched on, the first switching unit and the second switching unit are switched off.

12. The display device of claim 5, wherein when the first switching unit and the second switching unit are switched on, the third switching unit and the fourth switching unit are switched off, while when the third switching unit and the fourth switching unit are switched on, the first switching unit and the second switching unit are switched off.

13. The display device of claim 6, wherein when the first switching unit and the second switching unit are switched on, the third switching unit and the fourth switching unit are switched off, while when the third switching unit and the fourth switching unit are switched on, the first switching unit and the second switching unit are switched off.

14. The display device of claim 7, wherein when the first switching unit and the second switching unit are switched on, the third switching unit and the fourth switching unit are switched off, while when the third switching unit and the fourth switching unit are switched on, the first switching unit and the second switching unit are switched off.

* * * * *